US012104382B1

(12) United States Patent
Brown et al.

(10) Patent No.: US 12,104,382 B1
(45) Date of Patent: Oct. 1, 2024

(54) ROOFING DRIP EDGE DEVICE AND A METHOD OF INSTALLING A ROOFING DRIP EDGE DEVICE

(71) Applicant: BMIC LLC, Dallas, TX (US)

(72) Inventors: Randle Brown, Crawfordville, FL (US); James Willits, Fort Worth, TX (US); Venkata Nagarajan, Hawthorn Woods, IL (US); Mark Lienemann, Stillwater, MN (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 18/594,417

(22) Filed: Mar. 4, 2024

Related U.S. Application Data

(60) Provisional application No. 63/450,141, filed on Mar. 6, 2023.

(51) Int. Cl.
*E04D 13/04* (2006.01)

(52) U.S. Cl.
CPC .. *E04D 13/0459* (2013.01); *E04D 2013/0468* (2013.01)

(58) Field of Classification Search
CPC ..... E04D 13/0459; E04D 2013/0468; E04D 13/15; E04D 13/158
See application file for complete search history.

(56) References Cited

U.S. PATENT DOCUMENTS 3,192,670 A * 7/1965 Jones, III ..... E04D 13/15 52/302.1
6,578,322 B2 * 6/2003 Kintop ..... E04D 13/155 52/60
8,869,466 B2 * 10/2014 Garcia ..... E04F 19/00 52/60
9,163,408 B2 * 10/2015 West ..... E04D 13/1681
9,828,774 B2 11/2017 Givens
10,590,652 B2 * 3/2020 Dye ..... B21D 47/00
10,626,617 B2 * 4/2020 MeGee ..... E04D 13/15
11,492,805 B2 * 11/2022 Yang ..... E04D 5/146
2007/0074466 A1 * 4/2007 Rasmussen ..... E04D 13/15 52/97
2011/0033685 A1 * 2/2011 Folkersen ..... B32B 11/10 156/289

(Continued)

OTHER PUBLICATIONS

Johns Manville: "Presto-Weld Drip Edge", Retrieved from the Internet on Jan. 11, 2023: URL: https://www.jm.com/content/dam/jm/global/en/commercial-roofing/Data%20sheets/Specialty%20Roofing%20Products/RS-6117_PrestoWeld_Drip_edge.pdf.

(Continued)

*Primary Examiner* — Rodney Mintz
(74) *Attorney, Agent, or Firm* — Venable LLP

(57) ABSTRACT

This invention, in embodiments, relates to a roofing drip edge device that includes a drip edge comprising (i) an upper drip edge that is configured to be installed along an edge of a roofing surface, and (ii) a lower drip edge that is approximately at a right angle to the upper drip edge, a flashing strip member that is secured to the upper drip edge of the drip edge, such that a portion of the flashing strip member overhangs a first side edge of the drip edge, and a connecting member that is secured to the drip edge, such that a portion of the connecting member overhangs a second side edge of the drip edge. This invention, in embodiments, further relates to a method of installing a roofing drip edge device.

20 Claims, 6 Drawing Sheets

(56) References Cited

U.S. PATENT DOCUMENTS

| | | | | |
|---|---|---|---|---|
| 2013/0055651 | A1* | 3/2013 | Garcia | E04F 19/00 52/741.3 |
| 2014/0130447 | A1* | 5/2014 | West | E04D 13/1681 428/192 |
| 2015/0275520 | A1* | 10/2015 | Nawate | E04D 3/365 52/302.1 |
| 2017/0226741 | A1* | 8/2017 | Givens | E04D 13/158 |
| 2017/0259543 | A1* | 9/2017 | Folkersen | B32B 11/046 |
| 2018/0209153 | A1 | 7/2018 | Heo | |
| 2018/0266115 | A1* | 9/2018 | Dye | E04D 13/0459 |
| 2019/0071873 | A1 | 3/2019 | Dye | |
| 2020/0095773 | A1* | 3/2020 | MeGee | E04D 13/1478 |
| 2021/0230876 | A1* | 7/2021 | Yang | E04D 3/3603 |
| 2022/0205247 | A1* | 6/2022 | Zielinski | E04D 12/002 |

OTHER PUBLICATIONS

Metal-Era: "One Drip Edge TPO Skirted", Retrieved from the Internet on Jan. 11, 2023: URL: https://www.metalera.com/products/details/metal-era/edge-systems-one/one-drip-edge-tpo-skirted.

FlashCo: "FlashEdge Drip Edge", Retrieved from the Internet on Jan. 11, 2023: URL: https://www.flashco.com/wp-content/uploads/Drip-Edge-TPO-PDS.pdf.

* cited by examiner

ROOFING DRIP EDGE DEVICE AND A METHOD OF INSTALLING A ROOFING DRIP EDGE DEVICE

This application claims the priority of U.S. provisional application Ser. No. U.S. 63/450,141 entitled "A Roofing Drip Edge Device And A Method Of Installing A Roofing Drip Edge Device" filed Mar. 6, 2023, which is incorporated herein by reference in its entirety for all purposes.

FIELD OF THE INVENTION

This invention relates to a roofing drip edge device and methods of installing such a roofing drip edge device. A roofing drip edge device is provided that includes a metal edge secured (e.g., welded or pre-welded) to a flashing membrane (e.g., a TPO or PVC membrane) to offer labor savings, faster installation, and safety.

BACKGROUND OF THE INVENTION

Currently, commercial roof contractors hand weld a roofing membrane with edge metal strips while standing at the edge of the roof at a job site to create a metal drip edge. This hand welding of the roofing membrane results in high inefficiency with respect to labor cost, safety, and ease of installation. There is thus a need for a roofing drip edge device and methods of installing such a roofing drip edge device that allows for a simple, easy to use, pre-fabricated product that will improve safety, decrease labor cost, and allow for ease in installation.

SUMMARY OF THE INVENTION

One embodiment of this invention pertains to a roofing drip edge device that includes (a) a drip edge comprising (i) an upper drip edge that is configured to be installed along an edge of a roofing surface, (ii) a lower drip edge that is approximately at a right angle to the upper drip edge, (iii) a first side edge, and (iv) a second side edge that is opposite to the first side edge, (b) a flashing strip member having (i) an upper edge, (ii) a lower edge that is opposite to the upper edge, (iii) a first side edge, and (iv) a second side edge that is opposite to the first side edge, wherein the flashing strip member is secured to the upper drip edge of the drip edge along at least the lower edge of the flashing strip member, such that the first side edge of the flashing strip member extends past the first side edge of the drip edge to provide a portion of the flashing strip member that overhangs the first side edge of the drip edge, and (c) a connecting member having (i) an upper edge, (ii) a lower edge, (iii) a first side edge, and (iv) a second side edge that is opposite to the first side edge, wherein at least a portion of the first side edge of the connecting member is secured to the drip edge along the second side edge of the drip edge, such that the second side edge of the connecting member extends past the second side edge of the drip edge to provide a portion of the connecting member that overhangs the second side edge of the drip edge.

In one embodiment, the portion of the flashing strip member that overhangs the first side edge of the drip edge is configured to be attached to a drip edge of another roofing drip edge device.

In one embodiment, the portion of the connecting member that overhangs the second side edge of the drip edge is configured to be attached to a drip edge of another roofing drip edge device.

In one embodiment, the drip edge includes a first bond breaker element that is attached to the first side edge of the drip edge. According to an embodiment, the first bond breaker element is configured to attach to a connecting member of another roofing drip edge device. In one embodiment, the first bond breaker element comprises at least one of foil tape or duct tape.

In one embodiment, the drip edge includes a second bond breaker element that is attached to the second side edge of the drip edge. According to an embodiment, the second bond breaker element is configured to attach to the connecting member of the roofing drip edge device. In one embodiment, the second bond breaker element comprises at least one of foil tape or duct tape.

In one embodiment, the upper edge of the flashing strip member extends past the upper drip edge of the drip edge to provide a portion of the flashing strip member that overhangs the upper drip edge of the drip edge. According to an embodiment, the portion of the flashing strip member that overhangs the upper drip edge of the drip edge is configured to be attached to the roofing surface. According to an embodiment, the portion of the flashing strip member that overhangs the upper drip edge of the drip edge is configured to be attached to the roofing surface via at least one of heat welding or robot welding. According to one embodiment, the robot welding can be conducted at 10-12 fpm.

In one embodiment, the upper edge of the flashing strip member extends past the upper drip edge of the drip edge by at least two inches.

In one embodiment, the portion of the flashing strip member that overhangs the upper drip edge of the drip edge extends from 2 inches to 4 inches past the upper drip edge of the drip edge.

In one embodiment, the first side edge of the flashing strip member extends past the first side edge of the drip edge by at least one inch.

In one embodiment, the portion of the flashing strip member that overhangs the first side edge of the drip edge extends from 2 inches to 4 inches past the first side edge of the drip edge.

In one embodiment, the upper drip edge of the drip edge includes (i) a top end that is not secured to the flashing strip member, and (ii) a bottom end that is secured to the lower edge of the flashing strip member. According to one embodiment, the flashing strip member is secured to the drip edge from the bottom end of the upper drip edge of the drip edge to a portion of the upper drip edge of the drip edge that is at least 2 inches from the top end of the upper drip edge of the drip edge.

In one embodiment, the upper edge of the connecting member extends past the upper drip edge of the drip edge to provide a portion of the connecting member that overhangs the upper drip edge of the drip edge. According to an embodiment, the portion of the connecting member that overhangs the upper drip edge of the drip edge is configured to be attached to the roofing surface. According to an embodiment, the portion of the connecting member that overhangs the upper drip edge of the drip edge is configured to be attached to the roofing surface via at least one of heat welding or robot welding. According to one embodiment, the robot welding can be conducted at 10-12 fpm.

In one embodiment, the upper edge of the connecting member extends past the upper drip edge of the drip edge by at least two inches.

In one embodiment, the portion of the connecting member that overhangs the upper drip edge of the drip edge extends from 1 inch to 4 inches past the upper drip edge of the drip edge.

In one embodiment, the second side edge of the connecting member extends past the second side edge of the drip edge by at least one inch.

In one embodiment, the portion of the connecting member that overhangs the second side edge of the drip edge extends from 1 inch to 4 inches past the second side edge of the drip edge.

In one embodiment, the drip edge is coated. In one embodiment, the drip edge comprises a metal. In another embodiment, the drip edge comprises a metal coated with at least one of a TPO membrane or a PVC membrane.

In one embodiment, the flashing strip member comprises at least one of a TPO membrane or a PVC membrane.

In one embodiment, the flashing strip member comprises (i) a six inch flashing strip member or (ii) an eight inch flashing strip member.

In one embodiment, the connecting member comprises at least one of a TPO membrane or a PVC membrane.

In one embodiment, the roofing surface comprises (i) a roof deck, (ii) roof insulation, (iii) a roofing membrane, or (iv) a combination of (i), (ii), and/or (iii).

In one embodiment, the lower drip edge of the drip edge is configured to be attached to a continuous hook strip that is installed onto the roofing surface.

Another embodiment of this invention pertains to a method of installing a roofing drip edge device on a roofing surface, with the method comprising obtaining a first roofing drip edge device that includes (a) a drip edge comprising (i) an upper drip edge that is configured to be installed along an edge of the roofing surface, (ii) a lower drip edge that is approximately at a right angle to the upper drip edge, (iii) a first side edge, and (iv) a second side edge that is opposite to the first side edge, (b) a flashing strip member having (i) an upper edge, (ii) a lower edge that is opposite to the upper edge, (iii) a first side edge, and (iv) a second side edge that is opposite to the first side edge, wherein the first side edge of the flashing strip member extends past the first side edge of the drip edge to provide a portion of the flashing strip member that overhangs the first side edge of the drip edge, and (c) a connecting member having (i) an upper edge, (ii) a lower edge, (iii) a first side edge, and (iv) a second side edge that is opposite to the first side edge, wherein the second side edge of the connecting member extends past the second side edge of the drip edge to provide a portion of the connecting member that overhangs the second side edge of the drip edge, attaching the first roofing drip edge device to the roofing surface, and attaching at least the upper edge of the flashing strip member to the roofing surface.

In one embodiment, the attaching of the at least the upper edge of the flashing strip member to the roofing surface is conducted via at least one of heat welding or robot welding. In another embodiment, the attaching of the flashing strip member to the roofing surface is conducted via robot welding at 10 to 12 fpm.

In one embodiment, the flashing strip member is secured to the upper drip edge of the drip edge along at least the lower edge of the flashing strip member.

In another embodiment, the flashing strip member is not secured to the drip edge.

In one embodiment, at least a portion of the first side edge of the connecting member is secured to the drip edge along the second side edge of the drip edge.

In another embodiment, the connecting member is not secured to the drip edge.

In one embodiment, the method further includes attaching at least the upper edge of the connecting member to the roofing surface. In one embodiment, the attaching of the at least the upper edge of the connecting member to the roofing surface is conducted via at least one of heat welding or robot welding. In another embodiment, the attaching of the at least the upper edge of the connecting member to the roofing surface is conducted via robot welding at 10 to 12 fpm.

In one embodiment, the method further includes attaching a continuous hook strip to the roofing surface, such that at least the lower drip edge of the drip edge of the roofing drip edge device attaches to the continuous hook strip.

In one embodiment, the attaching of the roofing drip edge device to the roofing surface is conducted by fastening the roofing drip edge device to the roofing surface with fasteners.

In one embodiment, the method further includes obtaining a second roofing drip edge device that includes (i) a drip edge, (ii) a flashing strip member, and (iii) a connecting member, attaching the second roofing drip edge device to the roofing surface, such that the second roofing drip edge device is positioned adjacent to the first roofing drip edge device, and attaching the portion of the flashing strip member that overhangs the first side edge of the drip edge of the first roofing drip edge device to the connecting member of the second roofing drip edge device.

In one embodiment, the method further includes attaching the connecting member of the second roofing drip edge device to the drip edge of the first roofing drip edge device.

In one embodiment, the flashing strip member of the second roofing drip edge device is secured to the drip edge of the second roofing drip edge device.

In another embodiment, the flashing strip member of the second roofing drip edge device is not secured to the drip edge of the second roofing drip edge device.

In one embodiment, the connecting member of the second roofing drip edge device is secured to the drip edge of the second roofing drip edge device.

In another embodiment, the connecting member of the second roofing drip edge device is not secured to the drip edge of the second roofing drip edge device.

In one embodiment, the attaching of the second roofing drip edge device to the roofing surface is conducted such that the second roofing drip edge device is positioned adjacent to the first roofing drip edge device with an expansion space provided between the first roofing drip edge device and the second roofing drip edge device. In one embodiment, the expansion space provided between the first roofing drip edge device and the second roofing drip edge device is less than 1 inch in length. In one embodiment, the expansion space provided between the first roofing drip edge device and the second roofing drip edge device is ¼ inch in length.

In one embodiment, the method further includes attaching at least an upper edge of the flashing strip member of the second roofing drip edge device to the roofing surface. In one embodiment, the attaching of the at least an upper edge of the flashing strip member of the second roofing drip edge device to the roofing surface is conducted via at least one of heat welding or robot welding. In another embodiment, the attaching of the at least an upper edge of the flashing strip member of the second roofing drip edge device to the roofing surface is conducted via robot welding at 10 to 12 fpm.

In one embodiment, the method further includes attaching at least an upper edge of the connecting member of the second roofing drip edge device to the roofing surface. In one embodiment, the attaching of the at least an upper edge of the connecting member of the second roofing drip edge device to the roofing surface is conducted via at least one of heat welding or robot welding. In another embodiment, the attaching of the at least an upper edge of the connecting member of the second roofing drip edge device to the roofing surface is conducted via robot welding at 10 to 12 fpm.

In one embodiment, the drip edge of the first roofing drip edge device includes a bond breaker element that is attached to the first side edge of the drip edge of the first roofing drip edge device. According to an embodiment, the method further includes attaching the bond breaker element of the drip edge of the first roofing drip edge device to the connecting member of the second roofing drip edge device. In one embodiment, the bond breaker element of the drip edge of the first roofing drip edge device comprises at least one of foil tape or duct tape.

In one embodiment, the drip edge of the second roofing drip edge device includes a bond breaker element that is attached to a side edge of the drip edge of the second roofing drip edge device. According to an embodiment, the method further includes attaching the bond breaker element of the drip edge of the second roofing drip edge device to the connecting member of the second roofing drip edge device. In one embodiment, the second bond breaker element comprises at least one of foil tape or duct tape.

In one embodiment, the drip edge is coated. In one embodiment, the drip edge comprises a metal. In another embodiment, the drip edge comprises a metal coated with at least one of a TPO membrane or a PVC membrane.

In one embodiment, the flashing strip member comprises at least one of a TPO membrane or a PVC membrane.

In one embodiment, the flashing strip member comprises (i) a six inch flashing strip member or (ii) an eight inch flashing strip member.

In one embodiment, the connecting member comprises at least one of a TPO membrane or a PVC membrane.

In one embodiment, the roofing surface comprises (i) a roof deck, (ii) roof insulation, (iii) a roofing membrane, or (iv) a combination of (i), (ii), and/or (iii).

Another embodiment of this invention pertains to a roofing drip edge device that includes (a) a coated drip edge comprising (i) an upper drip edge that is configured to be installed along an edge of a roofing surface, (ii) a lower drip edge that is approximately at a right angle to the upper drip edge, (iii) a first side edge, (iv) a second side edge that is opposite to the first side edge, and (v) a first bond breaker element that is attached to the first side edge of the coated drip edge, (b) a flashing strip member having (i) an upper edge, (ii) a lower edge that is opposite to the upper edge, (iii) a first side edge, and (iv) a second side edge that is opposite to the first side edge, wherein the flashing strip member is secured to the upper drip edge of the coated drip edge along at least the lower edge of the flashing strip member, such that the first side edge of the flashing strip member extends past the first side edge of the coated drip edge to provide a portion of the flashing strip member that overhangs the first side edge of the coated drip edge, and (c) a connecting member having (i) an upper edge, (ii) a lower edge, (iii) a first side edge, and (iv) a second side edge that is opposite to the first side edge, wherein at least a portion of the first side edge of the connecting member is secured to the coated drip edge along the second side edge of the coated drip edge, such that the second side edge of the connecting member extends past the second side edge of the coated drip edge to provide a portion of the connecting member that overhangs the second side edge of the coated drip edge.

Yet another embodiment of this invention pertains to a roofing drip edge device that includes (a) a drip edge comprising (i) an upper drip edge that is configured to be installed along an edge of a roofing surface, (ii) a lower drip edge that is approximately at a right angle to the upper drip edge, (iii) a first side edge, and (iv) a second side edge that is opposite to the first side edge, (b) a flashing strip member having (i) an upper edge, (ii) a lower edge that is opposite to the upper edge, (iii) a first side edge, and (iv) a second side edge that is opposite to the first side edge, wherein the first side edge of the flashing strip member extends past the first side edge of the drip edge to provide a portion of the flashing strip member that overhangs the first side edge of the drip edge, and (c) a connecting member having (i) an upper edge, (ii) a lower edge, (iii) a first side edge, and (iv) a second side edge that is opposite to the first side edge, wherein the second side edge of the connecting member extends past the second side edge of the drip edge to provide a portion of the connecting member that overhangs the second side edge of the drip edge.

In one embodiment, the flashing strip member is secured to the upper drip edge of the drip edge along at least the lower edge of the flashing strip member.

In another embodiment, the flashing strip member is not secured to the drip edge.

In one embodiment, at least a portion of the first side edge of the connecting member is secured to the drip edge along the second side edge of the drip edge.

In another embodiment, the connecting member is not secured to the drip edge.

Another embodiment of this invention pertains to kit comprising a plurality of roofing drip edge devices, each roofing drip edge device of the plurality of roofing drip edge devices including (a) a drip edge comprising (i) an upper drip edge that is configured to be installed along an edge of a roofing surface, (ii) a lower drip edge that is approximately at a right angle to the upper drip edge, (iii) a first side edge, and (iv) a second side edge that is opposite to the first side edge, (b) a flashing strip member having (i) an upper edge, (ii) a lower edge that is opposite to the upper edge, (iii) a first side edge, and (iv) a second side edge that is opposite to the first side edge, wherein the first side edge of the flashing strip member extends past the first side edge of the drip edge to provide a portion of the flashing strip member that overhangs the first side edge of the drip edge, and (c) a connecting member having (i) an upper edge, (ii) a lower edge, (iii) a first side edge, and (iv) a second side edge that is opposite to the first side edge, wherein the second side edge of the connecting member extends past the second side edge of the drip edge to provide a portion of the connecting member that overhangs the second side edge of the drip edge.

In one embodiment, the flashing strip member is secured to the upper drip edge of the drip edge along at least the lower edge of the flashing strip member.

In another embodiment, the flashing strip member is not secured to the drip edge.

In one embodiment, at least a portion of the first side edge of the connecting member is secured to the drip edge along the second side edge of the drip edge.

In another embodiment, the connecting member is not secured to the drip edge.

BRIEF DESCRIPTION OF THE FIGURES

For a more complete understanding of the invention and the advantages thereof, reference is made to the following descriptions, taken in conjunction with the accompanying figures, in which.

DETAILED DESCRIPTION OF THE INVENTION

Figure 1:
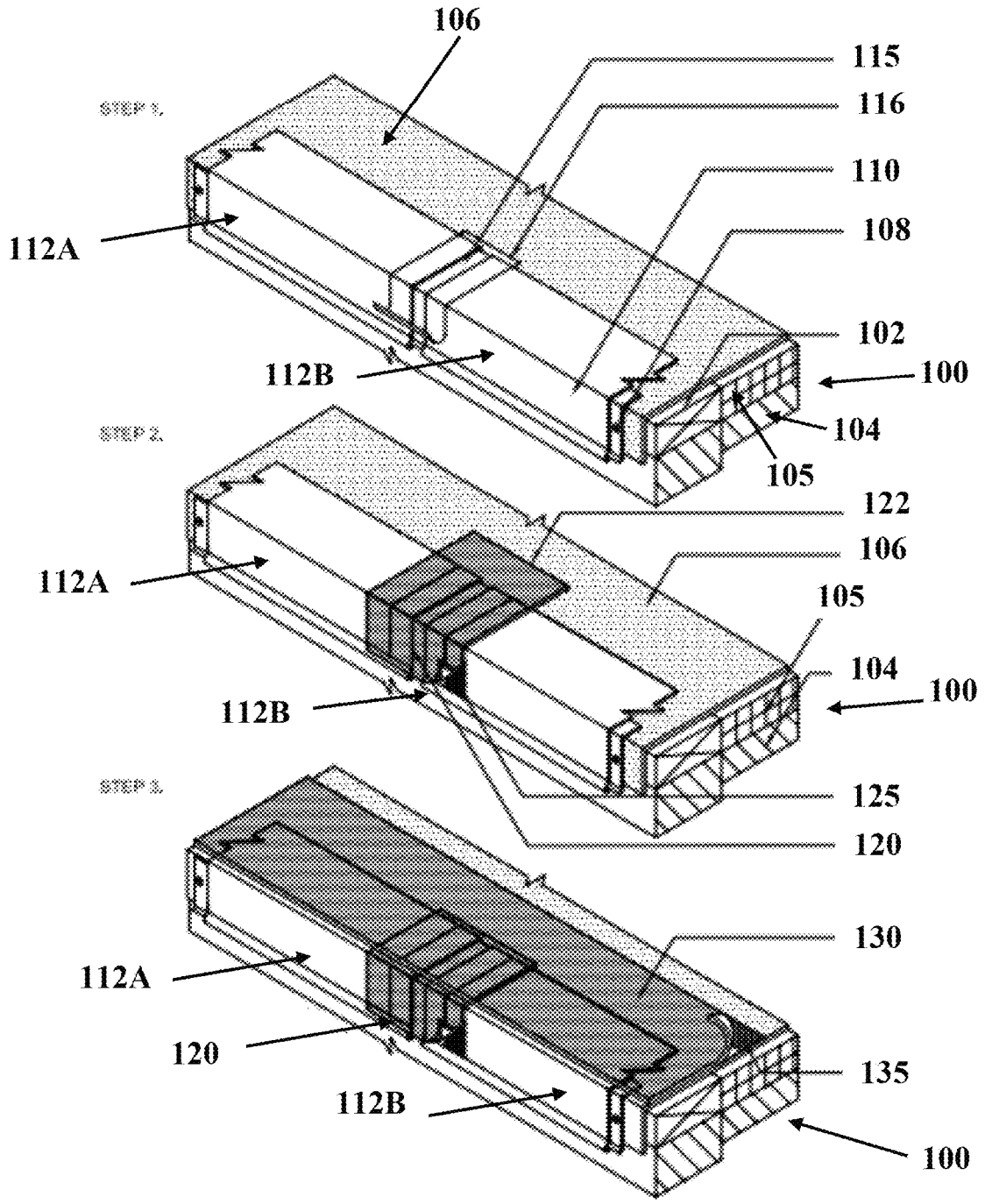
FIG. 1 PRIOR ART
FIG. 1 is an illustration of a current method of installing a roofing drip edge device.

Among those benefits and improvements that have been disclosed, other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though they may. Furthermore, the phrases "in another embodiment" and "in some other embodiments" as used herein do not necessarily refer to a different embodiment, although they may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising," "including," and "having" do not limit the scope of a specific claim to the materials or steps recited by the claim.

As used herein, terms such as "consisting of" and "composed of" limit the scope of a specific claim to the materials and steps recited by the claim.

All prior patents, publications, and test methods referenced herein are incorporated by reference in their entireties.

As used herein, the term "roofing surface" includes, but is not limited to, a roof deck or substrate, roof insulation, a roofing membrane, e.g., waterproofing membranes, a continuous hook strip, cover board, underlayment, shingles, tiles, and combinations thereof.

As used herein, the term "TPO" means thermoplastic polyolefin.

As used herein, the term "PVC" means polyvinyl chloride.

As used herein, the term "fpm" means feet per minute.

As used herein, the terms "pre-welded" or "pre-fabricated" mean that a flashing strip member or membrane is welded or secured to a drip edge during manufacturing of the roofing drip edge device, such that the flashing strip member or membrane is welded or secured to the drip edge prior to installation of the drip edge on to a roofing surface.

As used herein, the term "secured" means welded (including pre-welded), adhered, attached, mechanically attached, fastened, or any other means to attach two components together.

As used herein, the terms "attaching" or "attached" means welding or welded, adhering or adhered, mechanically attaching or mechanically attached, fastening or fastened, or any other means to attach two components together.

As used herein, the term "approximately" means plus or minus ten degrees.

Currently, commercial roof contractors hand weld a roofing membrane with edge metal strips while standing at the edge of the roof at a job site to create a metal drip edge. For example, to achieve a commercial workmanship warranty, the contractor is required, at roof perimeters, to terminate the roof with ANSI/SPRI/FM 4435/ES-1 compliant details. (See, e.g., ES-1, "Wind Test Design Standard for Edge Systems Used with Low Slope Roofing Systems," which is a standard addressing wind resistances testing of edge metal systems, except gutters, used to secure the perimeters of low-slope membrane roof systems.) Basically, the roofing membrane is required to wrap over the roof edge with an edge metal fastened over the top. This detail requires the edge metal to then be stripped in to waterproof the metal and fasteners. This can be done in a few different ways. One method is to use an adhered cover strip. Another method is to use TPO clad metal (on TPO systems) or PVC clad metal (for PVC systems) and heat weld a flashing strip to the metal and membrane. A few manufacturers allow the field membrane to be welded to the top of the clad metal, which is not ES-1 compliant. In that case, the roof perimeter is secured by only the bottom half of the membrane, which is not securing the reinforcing scrim layer. Thus, to achieve the ES-1 compliant details requires a considerable amount of labor by the installer, while working at the edge of the roof. This is tedious, slow, and dangerous. Accordingly, the current methods of creating a metal drip edge result in high inefficiency in labor cost, safety, and ease of installation.

For example, FIG. 1 illustrates a current method of installing a roofing drip edge device on a roofing surface. As shown in FIG. 1, in a first step, a roofing membrane 106 (e.g., a reinforced membrane) is installed on a roofing surface 100, with the roofing surface 100 including a wood nailer 102, a roof deck or substrate 104, and roof insulation 105. The wood nailer 102 is secured to the roof deck 104. A continuous hook strip 108 is secured (via, e.g., fasteners) to the roofing surface 100 and roofing membrane 106. To this continuous hook strip 108, a first roofing drip edge 112A (e.g., a coated metal drip edge) is installed adjacent to a second roofing drip edge 112B (e.g., a coated metal drip edge) with an expansion space 115 between the first roofing drip edge 112A and the second roofing drip edge 112B. The expansion space 115 can be sealed or covered with foil tape or duct tape 116 (including, e.g., a 2 inch (52 mm) piece of tape). Generally, the expansion space 115 is about ¼ inch in length.

As further shown in FIG. 1, in a second step, a membrane 120 (including, e.g., a 6 inch wide TPO membrane or an unreinforced PVC membrane) is installed on top of the foil tape or duct tape 116 and the expansion space 115. The membrane 120 further connects to the first roofing drip edge 112A and the second roofing drip edge 112B using heat welding (e.g., machine and/or hand welding) to create a heat-welded lap 125. The membrane 120 also attaches to the roofing membrane 106 via the heat-welded lap 125 by heat welding (e.g., machine and/or hand welding) along a portion 122 of the membrane 120 that extends onto the roofing membrane 106. The portion 122 of the membrane 120 generally extends a minimum of 2 inches onto the roofing membrane. As also shown in FIG. 1, in a third step, a flashing strip 130 (including, e.g., an 8 inch wide flashing strip or a 6 inch wide PVC strip) is installed on top of the first roofing drip edge 112A, the second roofing drip edge 112B, the membrane 120, the foil tape or duct tape 116, and the expansion space 115. The flashing strip 130 is heat welded by hand and/or machine during installation to create a heat-welded lap 135.

Thus, the purpose of the current invention is to offer a simple, easy to use, pre-fabricated product that will improve safety, labor cost, and ease of installation in a significant way. In this regard, a new pre-fabricated product is proposed that provides a pre-welded or secured TPO/PVC membrane to edge metal that will offer labor savings, faster installation, and safety. Thus, the proposed pre-fabricated product will address the current methods of hand welding single-ply TPO or PVC membranes with edge metal at the job site, which results in unsafe conditions for the installers, high labor cost, and low productivity.

One embodiment of this invention pertains to a roofing drip edge device that includes (a) a drip edge comprising (i) an upper drip edge that is configured to be installed along an edge of a roofing surface, (ii) a lower drip edge that is approximately at a right angle to the upper drip edge, (iii) a first side edge, and (iv) a second side edge that is opposite to the first side edge, (b) a flashing strip member having (i) an upper edge, (ii) a lower edge that is opposite to the upper edge, (iii) a first side edge, and (iv) a second side edge that is opposite to the first side edge, wherein the first side edge of the flashing strip member extends past the first side edge of the drip edge to provide a portion of the flashing strip member that overhangs the first side edge of the drip edge, and (c) a connecting member having (i) an upper edge, (ii) a lower edge, (iii) a first side edge, and (iv) a second side edge that is opposite to the first side edge, wherein the second side edge of the connecting member extends past the second side edge of the drip edge to provide a portion of the connecting member that overhangs the second side edge of the drip edge.

In one embodiment, the flashing strip member is secured (e.g., welded or pre-welded) to the upper drip edge of the drip edge along at least the lower edge of the flashing strip member.

In another embodiment, the flashing strip member is not secured to the drip edge.

In one embodiment, at least a portion of the first side edge of the connecting member is secured (e.g., welded or pre-welded) to the drip edge along the second side edge of the drip edge.

In another embodiment, the connecting member is not secured to the drip edge.

Figure 2:
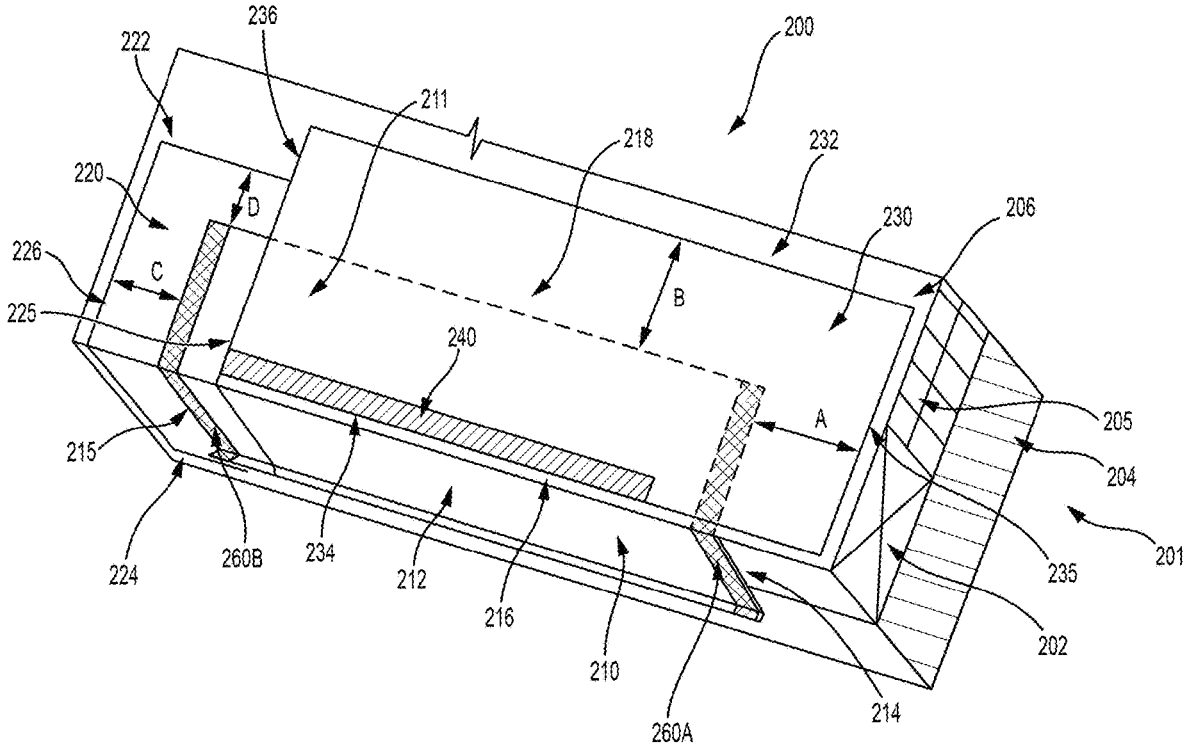
FIG. 2 is an illustration of a roofing drip edge device according to an embodiment of the invention.

FIG. 2 illustrates a roofing drip edge device 200 (e.g., a TPO clad edge metal, pre-made accessory product) according to an embodiment of the invention. In this embodiment, as shown in FIG. 2, the roofing drip edge device 200 includes a drip edge 210 (e.g., a TPO clad metal drip edge) having (i) an upper drip edge 211 that is configured to be installed onto a roofing surface 201 comprising a wood nailer 202, a roof deck or substrate 204, roof insulation 205, and a roofing membrane 206, (ii) a lower drip edge 212 that is approximately at a right angle to the upper drip edge 211, (iii) a first side edge 214, and (iv) a second side edge 215 that is opposite to the first side edge 214. The roofing drip edge device 200 further includes a flashing strip member 230 having (i) an upper edge 232, (ii) a lower edge 234 that is opposite to the upper edge 232, (iii) a first side edge 235, and (iv) a second side edge 236 that is opposite to the first side edge 235. According to the embodiment shown in FIG. 2, the flashing strip member 230 is secured (e.g., welded or pre-welded) (see, e.g., welded portion 240) to the upper drip edge 211 of the drip edge 210 along at least the lower edge 234 of the flashing strip member 230. As further shown in FIG. 2, the first side edge 235 of the flashing strip member 230 extends past the first side edge 214 of the drip edge 210 to provide a portion (see portion "A") of the flashing strip member 230 that overhangs the first side edge 214 of the drip edge 210. The roofing drip edge device 200 also includes a connecting member 220 (or membrane) having (i) an upper edge 222, (ii) a lower edge 224, (iii) a first side edge 225, and (iv) a second side edge 226 that is opposite to the first side edge 225. According to the embodiment shown in FIG. 2, at least a portion of the first side edge 225 of the connecting member 220 is secured (e.g., welded or pre-welded) to the drip edge 210 along the second side edge 215 of the drip edge 210, such that the second side edge 226 of the connecting member 220 extends past the second side edge 215 of the drip edge 210 to provide a portion (see portion "C") of the connecting member 220 that overhangs the second side edge 215 of the drip edge 210.

In one embodiment, the lower drip edge 212 of the drip edge 210 is configured to be attached to a continuous hook strip that is installed onto the roofing surface (see, e.g., continuous hook strip 108 of FIG. 1).

In one embodiment, the portion (see portion "A") of the flashing strip member 230 that overhangs the first side edge 214 of the drip edge 210 is configured to be attached to a drip edge of another roofing drip edge device (not shown).

In one embodiment, the first side edge 235 of the flashing strip member 230 extends past the first side edge 214 of the drip edge 210 by at least ½ inch. In one embodiment, the first side edge 235 of the flashing strip member 230 extends past the first side edge 214 of the drip edge 210 by at least one inch. In one embodiment, the first side edge 235 of the flashing strip member 230 extends past the first side edge 214 of the drip edge 210 by at least two inches. In one embodiment, the first side edge 235 of the flashing strip member 230 extends past the first side edge 214 of the drip edge 210 by at least three inches. In one embodiment, the first side edge 235 of the flashing strip member 230 extends past the first side edge 214 of the drip edge 210 by at least four inches.

In one embodiment, the portion (see portion "A") of the flashing strip member 230 that overhangs the first side edge 214 of the drip edge 210 extends from ½ inch to 4 inches past the first side edge 214 of the drip edge 210. In one embodiment, the portion (see portion "A") of the flashing strip member 230 that overhangs the first side edge 214 of the drip edge 210 extends from 1 inch to 4 inches past the first side edge 214 of the drip edge 210. In one embodiment, the portion (see portion "A") of the flashing strip member 230 that overhangs the first side edge 214 of the drip edge 210 extends from 2 inches to 4 inches past the first side edge 214 of the drip edge 210. In one embodiment, the portion (see portion "A") of the flashing strip member 230 that overhangs the first side edge 214 of the drip edge 210 extends from 3 inches to 4 inches past the first side edge 214 of the drip edge 210. In one embodiment, the portion (see portion "A") of the flashing strip member 230 that overhangs the first side edge 214 of the drip edge 210 extends from ½ inch to 3 inches past the first side edge 214 of the drip edge 210. In one embodiment, the portion (see portion "A") of the flashing strip member 230 that overhangs the first side edge 214 of the drip edge 210 extends from 1 inch to 3 inches past the first side edge 214 of the drip edge 210. In one embodiment, the portion (see portion "A") of the flashing strip member 230 that overhangs the first side edge 214 of the drip edge 210 extends from 2 inches to 3 inches past the first side edge 214 of the drip edge 210. In one embodiment, the portion (see portion "A") of the flashing strip member 230 that overhangs the first side edge 214 of the drip edge 210 extends from ½ inch to 2 inches past the first side edge 214 of the drip edge 210. In one embodiment, the portion (see portion "A") of the flashing strip member 230 that overhangs the first side edge 214 of the drip edge 210 extends from 1 inch to 2 inches past the first side edge 214 of the drip edge 210.

In one embodiment, the portion (see portion "C") of the connecting member 220 (or membrane) that overhangs the second side edge 215 of the drip edge 210 is configured to be attached to a drip edge of another roofing drip edge device (not shown).

In one embodiment, the second side edge 226 of the connecting member 220 extends past the second side edge 215 of the drip edge 210 by at least ½ inch. In one embodiment, the second side edge 226 of the connecting member 220 extends past the second side edge 215 of the drip edge 210 by at least one inch. In one embodiment, the second side edge 226 of the connecting member 220 extends past the second side edge 215 of the drip edge 210 by at least two inches. In one embodiment, the second side edge 226 of the connecting member 220 extends past the second side edge 215 of the drip edge 210 by at least three inches. In one embodiment, the second side edge 226 of the connecting member 220 extends past the second side edge 215 of the drip edge 210 by at least four inches.

In one embodiment, the portion (see portion "C") of the connecting member 220 that overhangs the second side edge 215 of the drip edge 210 extends from ½ inch to 4 inches past the second side edge 215 of the drip edge 210. In one embodiment, the portion (see portion "C") of the connecting member 220 that overhangs the second side edge 215 of the drip edge 210 extends from 1 inch to 4 inches past the second side edge 215 of the drip edge 210. In one embodiment, the portion (see portion "C") of the connecting member 220 that overhangs the second side edge 215 of the drip edge 210 extends from 2 inches to 4 inches past the second side edge 215 of the drip edge 210. In one embodiment, the portion (see portion "C") of the connecting member 220 that overhangs the second side edge 215 of the drip edge 210 extends from 3 inches to 4 inches past the second side edge 215 of the drip edge 210. In one embodiment, the portion (see portion "C") of the connecting member 220 that overhangs the second side edge 215 of the drip edge 210 extends from ½ inch to 3 inches past the second side edge 215 of the drip edge 210. In one embodiment, the portion (see portion "C") of the connecting member 220 that overhangs the second side edge 215 of the drip edge 210 extends from 1 inch to 3 inches past the second side edge 215 of the drip edge 210. In one embodiment, the portion (see portion "C") of the connecting member 220 that overhangs the second side edge 215 of the drip edge 210 extends from 2 inches to 3 inches past the second side edge 215 of the drip edge 210. In one embodiment, the portion (see portion "C") of the connecting member 220 that overhangs the second side edge 215 of the drip edge 210 extends from ½ inch to 2 inches past the second side edge 215 of the drip edge 210. In one embodiment, the portion (see portion "C") of the connecting member 220 that overhangs the second side edge 215 of the drip edge 210 extends from 1 inch to 2 inches past the second side edge 215 of the drip edge 210.

As further shown in FIG. 2, the drip edge 210 includes a first bond breaker element 260A that is attached to the first side edge 214 of the drip edge 210. According to an embodiment, the first bond breaker element 260A is configured to attach to a connecting member of another roofing drip edge device (not shown). As also shown in FIG. 2, the drip edge 210 includes a second bond breaker element 260B that is attached to the second side edge 215 of the drip edge 210. According to an embodiment, the second bond breaker element 260B is configured to attach to the connecting member 220 of the roofing drip edge device 200 during installation. In one embodiment, the first bond breaker element 260A and/or the second bond breaker element 260B comprises at least one of foil tape or duct tape. According to one embodiment, the first and/or second bond break elements (260A, 260B) allow for minimizing membrane rupture due to expansion (e.g., thermal expansion) and/or contraction of the roofing drip edge device 200.

As also shown in the embodiment of FIG. 2, the upper edge 232 of the flashing strip member 230 extends past the upper drip edge 211 of the drip edge 210 to provide a portion (see portion "B") of the flashing strip member 230 that overhangs the upper drip edge 211 of the drip edge 210. According to an embodiment, the portion (see portion "B") of the flashing strip member 230 that overhangs the upper drip edge 211 of the drip edge 210 is configured to be attached to the roofing surface (including, e.g., roofing membrane 206). According to an embodiment, the portion (see portion "B") of the flashing strip member 230 that overhangs the upper drip edge 211 of the drip edge 210 is configured to be attached to the roofing surface (including, e.g., roofing membrane 206) via at least one of heat welding (e.g., machine and/or hand welding) and/or robot welding. According to one embodiment, the robot welding can be conducted at 10-12 fpm.

In one embodiment, the upper edge 232 of the flashing strip member 230 extends past the upper drip edge 211 of the drip edge 210 by at least ½ inch. In one embodiment, the upper edge 232 of the flashing strip member 230 extends past the upper drip edge 211 of the drip edge 210 by at least one inch. In one embodiment, the upper edge 232 of the flashing strip member 230 extends past the upper drip edge 211 of the drip edge 210 by at least two inches. In one embodiment, the upper edge 232 of the flashing strip member 230 extends past the upper drip edge 211 of the drip edge 210 by at least three inches. In one embodiment, the upper edge 232 of the flashing strip member 230 extends past the upper drip edge 211 of the drip edge 210 by at least four inches.

In one embodiment, the portion (see portion "B") of the flashing strip member 230 that overhangs the upper drip edge 211 of the drip edge 210 extends from ½ inch to 4 inches past the upper drip edge 211 of the drip edge 210. In one embodiment, the portion (see portion "B") of the flashing strip member 230 that overhangs the upper drip edge 211 of the drip edge 210 extends from 1 inch to 4 inches past the upper drip edge 211 of the drip edge 210. In one embodiment, the portion (see portion "B") of the flashing strip member 230 that overhangs the upper drip edge 211 of the drip edge 210 extends from 2 inches to 4 inches past the upper drip edge 211 of the drip edge 210. In one embodiment, the portion (see portion "B") of the flashing strip member 230 that overhangs the upper drip edge 211 of the drip edge 210 extends from 3 inches to 4 inches past the upper drip edge 211 of the drip edge 210. In one embodiment, the portion (see portion "B") of the flashing strip member 230 that overhangs the upper drip edge 211 of the drip edge 210 extends from ½ inch to 3 inches past the upper drip edge 211 of the drip edge 210. In one embodiment, the portion (see portion "B") of the flashing strip member 230 that overhangs the upper drip edge 211 of the drip edge 210 extends from 1 inch to 3 inches past the upper drip edge 211 of the drip edge 210. In one embodiment, the portion (see portion "B") of the flashing strip member 230 that overhangs the upper drip edge 211 of the drip edge 210 extends from 2 inches to 3 inches past the upper drip edge 211 of the drip edge 210. In one embodiment, the portion (see portion "B") of the flashing strip member 230 that overhangs the upper drip edge 211 of the drip edge 210 extends from ½ inch to 2 inches past the upper drip edge 211 of the drip edge 210. In one embodiment, the portion (see portion "B") of the flashing strip member 230 that overhangs the upper drip edge 211 of the drip edge 210 extends from 1 inch to 2 inches past the upper drip edge 211 of the drip edge 210.

In one embodiment, as shown in FIG. 2, the upper drip edge 211 of the drip edge 210 includes (i) a top end 218 that is not secured (e.g., welded or pre-welded) to the flashing strip member 230, and (ii) a bottom end 216 that is secured (e.g., welded or pre-welded) to the lower edge 234 of the flashing strip member 230 (see, e.g., welded portion 240). According to one embodiment, the flashing strip member 230 is secured (e.g., welded or pre-welded) to the drip edge 210 from the bottom end 216 of the upper drip edge 211 of the drip edge 210 to a portion of the upper drip edge 211 of the drip edge 210 that is at least 2 inches from the top end 218 of the upper drip edge 211 of the drip edge 210.

As further shown in the embodiment of FIG. 2, the upper edge 222 of the connecting member 220 extends past the upper drip edge 210 of the drip edge 210 to provide a portion (see portion "D") of the connecting member 220 that overhangs the upper drip edge 211 of the drip edge 210. According to an embodiment, the portion (see portion "D") of the connecting member 220 that overhangs the upper drip edge 211 of the drip edge 210 is configured to be attached to the roofing surface (including, e.g., roofing membrane 206). According to an embodiment, the portion (see portion "D") of the connecting member 220 that overhangs the upper drip edge 211 of the drip edge 210 is configured to be attached to the roofing surface (including, e.g., roofing membrane 206) via at least one of heat welding (e.g., machine and/or hand welding) and/or robot welding. According to one embodiment, the robot welding can be conducted at 10-12 fpm.

In one embodiment, the upper edge 222 of the connecting member 220 extends past the upper drip edge 211 of the drip edge 210 by at least ½ inch. In one embodiment, the upper edge 222 of the connecting member 220 extends past the upper drip edge 211 of the drip edge 210 by at least one inch. In one embodiment, the upper edge 222 of the connecting member 220 extends past the upper drip edge 211 of the drip edge 210 by at least two inches. In one embodiment, the upper edge 222 of the connecting member 220 extends past the upper drip edge 211 of the drip edge 210 by at least three inches. In one embodiment, the upper edge 222 of the connecting member 220 extends past the upper drip edge 211 of the drip edge 210 by at least four inches.

In one embodiment, the portion (see portion "D") of the connecting member 220 that overhangs the upper drip edge 211 of the drip edge 210 extends from ½ inch to 4 inches past the upper drip edge 211 of the drip edge 210. In one embodiment, the portion (see portion "D") of the connecting member 220 that overhangs the upper drip edge 211 of the drip edge 210 extends from 1 inch to 4 inches past the upper drip edge 211 of the drip edge 210. In one embodiment, the portion (see portion "D") of the connecting member 220 that overhangs the upper drip edge 211 of the drip edge 210 extends from 2 inches to 4 inches past the upper drip edge 211 of the drip edge 210. In one embodiment, the portion (see portion "D") of the connecting member 220 that overhangs the upper drip edge 211 of the drip edge 210 extends from 3 inches to 4 inches past the upper drip edge 211 of the drip edge 210. In one embodiment, the portion (see portion "D") of the connecting member 220 that overhangs the upper drip edge 211 of the drip edge 210 extends from ½ inch to 3 inches past the upper drip edge 211 of the drip edge 210. In one embodiment, the portion (see portion "D") of the connecting member 220 that overhangs the upper drip edge 211 of the drip edge 210 extends from 1 inch to 3 inches past the upper drip edge 211 of the drip edge 210. In one embodiment, the portion (see portion "D") of the connecting member 220 that overhangs the upper drip edge 211 of the drip edge 210 extends from 2 inches to 3 inches past the upper drip edge 211 of the drip edge 210. In one embodiment, the portion (see portion "D") of the connecting member 220 that overhangs the upper drip edge 211 of the drip edge 210 extends from ½ inch to 2 inches past the upper drip edge 211 of the drip edge 210. In one embodiment, the portion (see portion "D") of the connecting member 220 that overhangs the upper drip edge 211 of the drip edge 210 extends from 1 inch to 2 inches past the upper drip edge 211 of the drip edge 210.

Figure 3A:
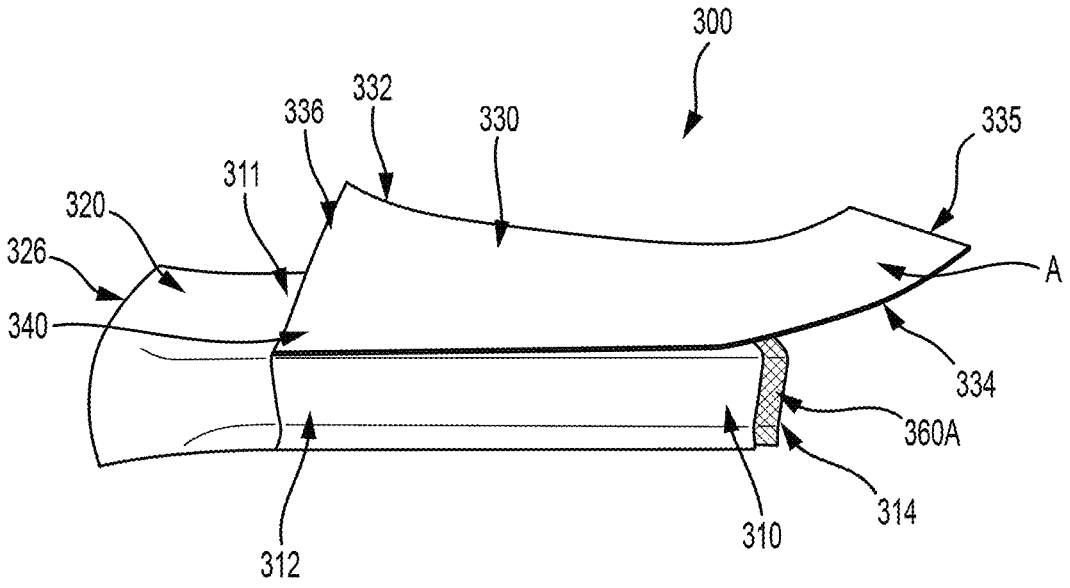
FIG. 3A is a top perspective view of a roofing drip edge device according to an embodiment of the invention.
Figure 3B:
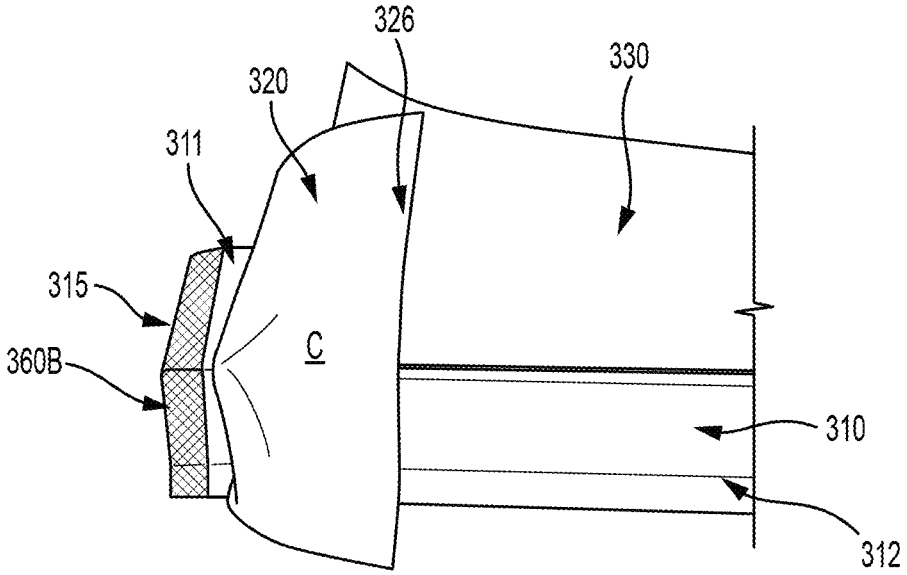
FIG. 3B is a partial, top perspective view of one end of the roofing drip edge device of FIG. 3A according to an embodiment of the invention.
Figure 3C:
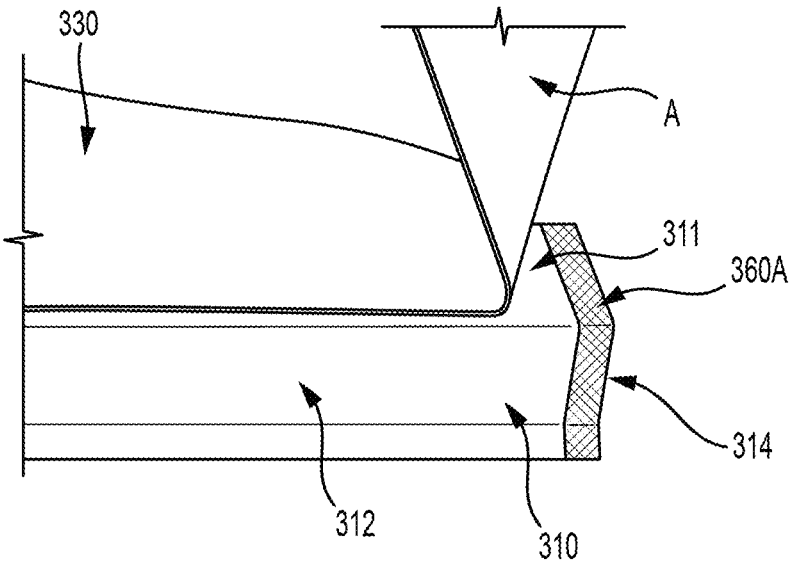
FIG. 3C is a partial, top perspective view of another end of the roofing drip edge device of FIG. 3A according to an embodiment of the invention.

FIGS. 3A-3E illustrate a roofing drip edge device 300 according to another embodiment of the invention. In this embodiment, as shown in FIGS. 3A and 3B, the roofing drip edge device 300 includes a drip edge 310 (e.g., a TPO clad metal drip edge) having (i) an upper drip edge 311 that is configured to be installed onto a roofing surface (not shown), (ii) a lower drip edge 312 that is approximately at a right angle to the upper drip edge 311, (iii) a first side edge 314, and (iv) a second side edge 315 that is opposite to the first side edge 314. The roofing drip edge device 300 further includes a flashing strip member 330 and a connecting member 320. As shown in FIG. 3A, the flashing strip member 330 has (i) an upper edge 332, (ii) a lower edge 334 that is opposite to the upper edge 332, (iii) a first side edge 335, and (iv) a second side edge 336 that is opposite to the first side edge 335. According to the embodiment shown in FIG. 3A, the flashing strip member 330 is secured (see, e.g., welded portion 340) to the upper drip edge 311 of the drip edge 310 along at least the lower edge 334 of the flashing strip member 330. As further shown in FIGS. 3A and 3C, the first side edge 335 of the flashing strip member 330 extends past the first side edge 314 of the drip edge 310 to provide a portion (see portion "A") of the flashing strip member 330 that overhangs the first side edge 314 of the drip edge 310. In one embodiment, the portion (see portion "A") of the flashing strip member 330 that overhangs the first side edge 314 of the drip edge 310 is configured to be attached to a drip edge of another roofing drip edge device (not shown). As also shown in FIGS. 3A and 3C, the drip edge 310 includes a first bond breaker element 360A that is attached to the first side edge 314 of the drip edge 310. According to an embodiment, the first bond breaker element 360A is configured to attach to a connecting member of another roofing drip edge device (not shown). As also shown in FIG. 3B, the drip edge 310 includes a second bond breaker element 360B that is attached to the second side edge 315 of the drip edge 310. According to an embodiment, the second bond breaker element 360B is configured to attach to the connecting member 320 of the roofing drip edge device 300 during installation. In one embodiment, the first bond breaker element 360A and/or the second bond breaker element 360B comprises at least one of foil tape or duct tape. According to one embodiment, the first and/or second bond break elements (360A, 360B) allow for minimizing membrane rupture due to expansion and/or contraction of the roofing drip edge device 300.

As discussed above, the roofing drip edge device 300 also includes a connecting member 320 (or membrane). According to the embodiment shown in FIGS. 3A and 3B, at least a portion of the connecting member 320 is secured to the drip edge 310, such that a side edge 326 of the connecting member 320 extends past the second side edge 315 of the drip edge 310 to provide a portion (see portion "C") of the connecting member 320 that overhangs the second side edge 315 of the drip edge 310. As shown in the embodiment of FIG. 3B, the portion (see portion "C") of the connecting member 320 that overhangs the second side edge 315 of the drip edge 310 is able to be folded back to expose the bond breaker element 360B, as described above. In one embodiment, the portion (see portion "C") of the connecting member 320 (or membrane) that overhangs the second side edge 315 of the drip edge 310 is configured to be attached to a drip edge of another roofing drip edge device (not shown).

Figure 3D:
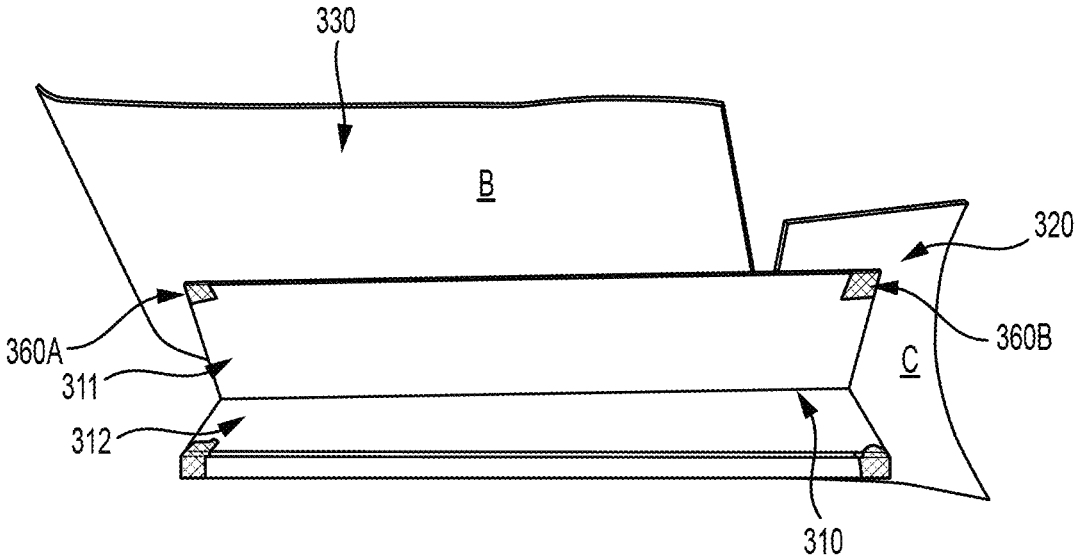
FIG. 3D is a bottom perspective view of the roofing drip edge device of FIG. 3A according to an embodiment of the invention.

FIG. 3D is a bottom perspective view of the roofing drip edge device 300 according to an embodiment of the invention. As shown in the embodiment of FIG. 3D, the first bond breaker element 360A and the second bond breaker element 360B extend around to the back of the drip edge 310. As also shown in the embodiment of FIG. 3D, the flashing strip member 330 includes a portion (see portion "B") that overhangs the upper drip edge 311 of the drip edge 310. According to an embodiment, the portion (see portion "B") of the flashing strip member 330 that overhangs the upper drip edge 311 of the drip edge 310 is configured to be attached to the roofing surface (not shown). According to an embodiment, the portion (see portion "B") of the flashing strip member 330 that overhangs the upper drip edge 311 of the drip edge 310 is configured to be attached to the roofing surface via at least one of heat welding (e.g., machine and/or hand welding) and/or robot welding. According to one embodiment, the robot welding can be conducted at 10-12 fpm.

Figure 3E:
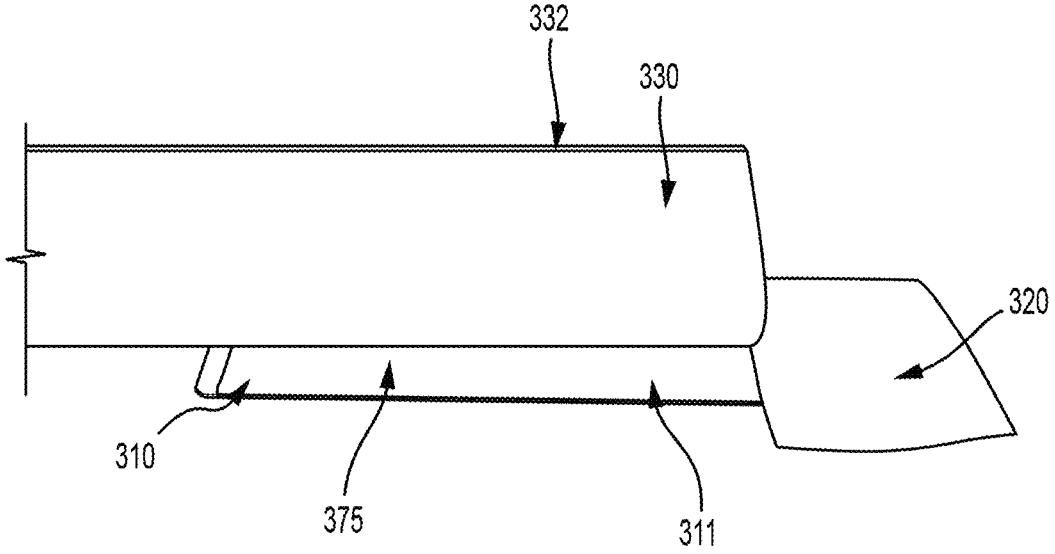
FIG. 3E is a rear perspective view of the roofing drip edge device of FIG. 3A according to an embodiment of the invention.

FIG. 3E is a rear perspective view of the roofing drip edge device 300 according to an embodiment of the invention. As shown in the embodiment of FIG. 3E, the flashing strip member 330 is secured to the upper drip edge 311 of the drip edge 310 along at least the lower edge (not shown) of the flashing strip member 330, with the upper edge 332 of the flashing strip member 330 being unattached (or unsecured) to the upper drip edge 311 of the drip edge 310. As further shown in the embodiment FIG. 3E, since the upper edge 332 of the flashing strip member 330 is unattached to the upper drip edge 311 of the drip edge 310, the flashing strip member 330 can be folded back in order to expose a portion 375 of the upper drip edge 311 of the drip edge 310 that can be attached or fastened to a roof surface using, e.g., fasteners (including, e.g., nails, screws, etc.).

In one embodiment, the drip edge is coated. In one embodiment, the drip edge comprises a metal. In another embodiment, the drip edge comprises a metal coated with at least one of a TPO membrane or a PVC membrane. In one embodiment, the metal comprises galvanized steel, aluminum, or a combination thereof.

In one embodiment, the flashing strip member comprises at least one of a TPO membrane or a PVC membrane.

In one embodiment, the flashing strip member comprises (i) a six inch flashing strip member or (ii) an eight inch flashing strip member.

In one embodiment, the connecting member comprises at least one of a TPO membrane or a PVC membrane.

In one embodiment, the roofing surface comprises (i) a roof deck, (ii) roof insulation, (iii) a roofing membrane, or (iv) a combination of (i), (ii), and/or (iii).

In one embodiment, the upper drip edge of the drip edge extends at a right angle to the lower drip edge of the drip edge (see, e.g., FIGS. 2 and 3A).

Another embodiment of this invention pertains to a method of installing a roofing drip edge device on a roofing surface, with the method comprising obtaining a first roofing drip edge device that includes (a) a drip edge comprising (i) an upper drip edge that is configured to be installed along an edge of the roofing surface, (ii) a lower drip edge that is approximately at a right angle to the upper drip edge, (iii) a first side edge, and (iv) a second side edge that is opposite to the first side edge, (b) a flashing strip member having (i) an upper edge, (ii) a lower edge that is opposite to the upper edge, (iii) a first side edge, and (iv) a second side edge that is opposite to the first side edge, wherein the first side edge of the flashing strip member extends past the first side edge of the drip edge to provide a portion of the flashing strip member that overhangs the first side edge of the drip edge, and (c) a connecting member having (i) an upper edge, (ii) a lower edge, (iii) a first side edge, and (iv) a second side edge that is opposite to the first side edge, wherein the second side edge of the connecting member extends past the second side edge of the drip edge to provide a portion of the connecting member that overhangs the second side edge of the drip edge, attaching the first roofing drip edge device to the roofing surface, and attaching at least the upper edge of the flashing strip member to the roofing surface.

In one embodiment, the flashing strip member is secured to the upper drip edge of the drip edge along at least the lower edge of the flashing strip member.

In another embodiment, the flashing strip member is not secured to the drip edge.

In one embodiment, at least a portion of the first side edge of the connecting member is secured to the drip edge along the second side edge of the drip edge.

In another embodiment, the connecting member is not secured to the drip edge.

Figure 4:
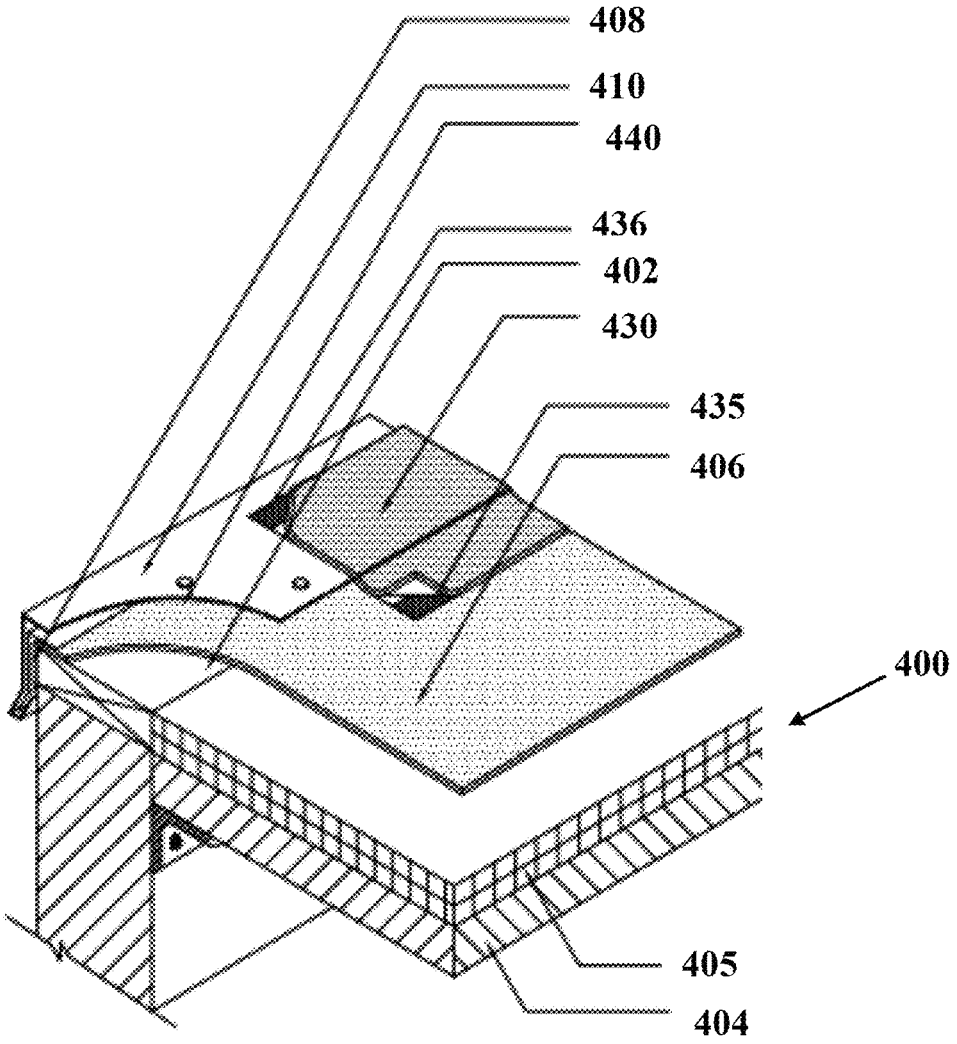
FIG. 4 is an illustration of a roofing drip edge device installed on a roofing surface according to an embodiment of the invention.

FIG. 4 illustrates a roofing drip edge device installed on a roofing surface according to an embodiment of the invention. As shown in FIG. 4, a roofing membrane 406 (e.g., a reinforced membrane) is installed on a roofing surface 400, with the roofing surface 400 including a wood nailer 402, a roof deck or substrate 404, and roof insulation 405. The wood nailer 402 is secured to the roof deck 404. A continuous hook strip 408 is secured (via, e.g., fasteners) to the roofing surface 400 and roofing membrane 406. To this continuous hook strip 408, a roofing drip edge device 410 having the features described above is installed onto the roofing surface 400 and/or the roofing membrane 406 using fasteners 440 (e.g., nails, screws, etc.). As further shown in the embodiment of FIG. 4, a flashing strip member 430 (including, e.g., an 8 inch wide flashing strip or a 6 inch wide PVC strip) is secured to the roofing drip edge device 410 via a heat-welded lap 436. The flashing strip member 430 is further heat welded or attached to the roofing surface 400 and/or the roofing membrane 406 by hand and/or machine during installation to create a heat-welded lap 335.

In one embodiment, the attaching of the at least the upper edge of the flashing strip member to the roofing surface is conducted via at least one of heat welding (e.g., hand and/or machine welding) or robot welding. According to one embodiment, the robot welding can be conducted at 10-12 fpm.

In one embodiment, the method further includes attaching at least the upper edge of the connecting member to the roofing surface. In one embodiment, the attaching of the at least the upper edge of the connecting member to the roofing surface is conducted via at least one of heat welding (e.g., hand and/or machine welding) or robot welding. According to one embodiment, the robot welding can be conducted at 10-12 fpm.

In one embodiment, the method further includes attaching a continuous hook strip to the roofing surface, such that at least the lower drip edge of the drip edge of the roofing drip edge device attaches to the continuous hook strip (see, e.g., continuous hook strip 408 of FIG. 4).

In one embodiment, the attaching of the roofing drip edge device to the roofing surface is conducted by fastening the roofing drip edge device to the roofing surface with fasteners (see, e.g., fasteners 440 in FIG. 4).

In one embodiment, the method further includes obtaining a second roofing drip edge device that includes (i) a drip edge, (ii) a flashing strip member that is secured or is not secured to the drip edge, and (iii) a connecting member that is secured or is not secured to the drip edge, attaching the second roofing drip edge device to the roofing surface, such that the second roofing drip edge device is positioned adjacent to the first roofing drip edge device, and attaching the portion of the flashing strip member that overhangs the first side edge of the drip edge of the first roofing drip edge device to the connecting member of the second roofing drip edge device.

In one embodiment, the method further includes attaching the connecting member of the second roofing drip edge device to the drip edge of the first roofing drip edge device.

In one embodiment, the attaching of the second roofing drip edge device to the roofing surface is conducted such that the second roofing drip edge device is positioned adjacent to the first roofing drip edge device with an expansion space provided between the first roofing drip edge device and the second roofing drip edge device (see e.g., FIG. 1). In one embodiment, the expansion space provided between the first roofing drip edge device and the second roofing drip edge device is less than 1 inch in length. In one embodiment, the expansion space provided between the first roofing drip edge device and the second roofing drip edge device is ½ inch in length. In one embodiment, the expansion space provided between the first roofing drip edge device and the second roofing drip edge device is ¼ inch in length.

In one embodiment, the method further includes attaching at least an upper edge of the flashing strip member of the second roofing drip edge device to the roofing surface. In one embodiment, the attaching of the at least an upper edge of the flashing strip member of the second roofing drip edge device to the roofing surface is conducted via at least one of heat welding (e.g., hand and/or machine welding) or robot welding. According to one embodiment, the robot welding can be conducted at 10-12 fpm.

In one embodiment, the method further includes attaching at least an upper edge of the connecting member of the second roofing drip edge device to the roofing surface. In one embodiment, the attaching of the at least an upper edge of the connecting member of the second roofing drip edge device to the roofing surface is conducted via at least one of heat welding (e.g., hand and/or machine welding) or robot welding. According to one embodiment, the robot welding can be conducted at 10-12 fpm.

According to embodiments of the invention described herein, a roofing edge metal piece is provided that is secured (e.g., welded or pre-welded) in a factory with either a TPO or PVC membrane.

According to embodiments of the invention described herein, a pre-made TPO or PVC clad roofing edge metal is provided that incorporates a flashing strip (e.g., an 8 inch wide flashing strip) and a bond-breaker detail or element. This pre-made roofing edge metal is able to save the contractor the labor of hand welding the flashing strip on the edge of the roof, as well as create a safer installation by minimizing the installer's time at the edge of the roof. This pre-made roofing edge metal will allow for the use of the bond-breaker detail or element to minimize membrane rupture due to expansion (e.g., thermal expansion) and contraction of the edge metal, resulting in a better roof.

Although the invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

The invention claimed is:

1. A roofing drip edge device comprising:

a coated drip edge comprising (i) an upper drip edge that is configured to be installed along an edge of a roofing surface, (ii) a lower drip edge that is approximately at a right angle to the upper drip edge, the lower drip edge configured to be attached to a continuous hook strip installed on the roofing surface, (iii) a first side edge, (iv) a second side edge that is opposite to the first side edge, and (v) a first bond breaker element that is attached to the first side edge of the coated drip edge;

a flashing strip member having (i) an upper edge, (ii) a lower edge that is opposite to the upper edge, (iii) a first side edge, and (iv) a second side edge that is opposite to the first side edge, wherein the flashing strip member is secured to the upper drip edge of the coated drip edge along at least the lower edge of the flashing strip member, such that the first side edge of the flashing strip member extends past the first side edge of the coated drip edge to provide a portion of the flashing strip member that overhangs the first side edge of the coated drip edge; and a connecting member having (i) an upper edge, (ii) a lower edge, (iii) a first side edge, and (iv) a second side edge that is opposite to the first side edge, wherein at least a portion of the first side edge of the connecting member is secured to the coated drip edge along the second side edge of the coated drip edge, such that the second side edge of the connecting member extends past the second side edge of the coated drip edge to provide a portion of the connecting member that overhangs the second side edge of the coated drip edge.

2. The roofing drip edge device according to claim 1, wherein the coated drip edge includes a second bond breaker element that is attached to the second side edge of the coated drip edge.

3. The roofing drip edge device according to claim 1, wherein the first bond breaker element comprises at least one of foil tape or duct tape.

4. A roofing drip edge device comprising:

a drip edge comprising (i) an upper drip edge that is configured to be installed along an edge of a roofing surface, (ii) a lower drip edge that is approximately at a right angle to the upper drip edge, the lower drip edge configured to be attached to a continuous hook strip installed on the roofing surface, (iii) a first side edge, (iv) a second side edge that is opposite to the first side edge, and (v) a bond breaker element that is attached to one of the first side edge or the second side edge of the drip edge;

a flashing strip member having (i) an upper edge, (ii) a lower edge that is opposite to the upper edge, (iii) a first side edge, and (iv) a second side edge that is opposite to the first side edge, wherein the flashing strip member is secured to the upper drip edge of the drip edge along at least the lower edge of the flashing strip member, such that the first side edge of the flashing strip member extends past the first side edge of the drip edge to provide a portion of the flashing strip member that overhangs the first side edge of the drip edge; and a connecting member having (i) an upper edge, (ii) a lower edge, (iii) a first side edge, and (iv) a second side edge that is opposite to the first side edge, wherein at least a portion of the first side edge of the connecting member is secured to the drip edge along the second side edge of the drip edge, such that the second side edge of the connecting member extends past the second side edge of the drip edge to provide a portion of the connecting member that overhangs the second side edge of the drip edge.

5. The roofing drip edge device according to claim 4, wherein the portion of the flashing strip member that overhangs the first side edge of the drip edge is configured to be attached to a drip edge of another roofing drip edge device.

6. The roofing drip edge device according to claim 4, wherein the portion of the connecting member that overhangs the second side edge of the drip edge is configured to be attached to a drip edge of another roofing drip edge device.

7. The roofing drip edge device according to claim 4, wherein the upper edge of the flashing strip member extends past the upper drip edge of the drip edge to provide a portion of the flashing strip member that overhangs the upper drip edge of the drip edge.

8. The roofing drip edge device according to claim 4, wherein the upper drip edge of the drip edge includes (i) a top end that is not secured to the flashing strip member, and (ii) a bottom end that is secured to the lower edge of the flashing strip member.

9. The roofing drip edge device according to claim 4, wherein the upper edge of the connecting member extends past the upper drip edge of the drip edge to provide a portion of the connecting member that overhangs the upper drip edge of the drip edge.

10. The roofing drip edge device according to claim 4, wherein the drip edge comprises one of (i) a metal, (ii) a metal coated with at least one of a TPO membrane or a PVC membrane, or (iii) a combination of (i) and (ii).

11. The roofing drip edge device according to claim 4, wherein at least one of the flashing strip member or the connecting member comprises at least one of a TPO membrane or a PVC membrane.

12. The roofing drip edge device according to claim 4, wherein the bond breaker element is a first bond breaker element that is attached to the first side edge of the drip edge.

13. The roofing drip edge device according to claim 12, wherein the first bond breaker element is configured to attach to a connecting member of another roofing drip edge device.

14. The roofing drip edge device according to claim 12, wherein the first bond breaker element comprises at least one of foil tape or duct tape.

15. The roofing drip edge device according to claim 12, wherein the drip edge further includes a second bond breaker element that is attached to the second side edge of the drip edge.

16. A method comprising:

obtaining a first roofing drip edge device that includes:

a drip edge comprising (i) an upper drip edge that is configured to be installed along an edge of a roofing surface, (ii) a lower drip edge that is approximately at a right angle to the upper drip edge, the lower drip edge configured to be attached to a continuous hook strip installed on the roofing surface, (iii) a first side edge, (iv) a second side edge that is opposite to the first side edge, and (v) a bond breaker element that is attached to one of the first side edge or the second side edge of the drip edge, a flashing strip member having (i) an upper edge, (ii) a lower edge that is opposite to the upper edge, (iii) a first side edge, and (iv) a second side edge that is opposite to the first side edge, wherein the first side edge of the flashing strip member extends past the first side edge of the drip edge to provide a portion of the flashing strip member that overhangs the first side edge of the drip edge, and a connecting member having (i) an upper edge, (ii) a lower edge, (iii) a first side edge, and (iv) a second side edge that is opposite to the first side edge, wherein the second side edge of the connecting member extends past the second side edge of the drip edge to provide a portion of the connecting member that overhangs the second side edge of the drip edge;

attaching the first roofing drip edge device to the roofing surface; and attaching at least the upper edge of the flashing strip member to the roofing surface.

17. The method according to claim 16, wherein the attaching of the at least the upper edge of the flashing strip member to the roofing surface is conducted via at least one of heat welding or robot welding.

18. The method according to claim 16, further comprising attaching at least the upper edge of the connecting member to the roofing surface.

19. The method according to claim 16, wherein the flashing strip member is secured to the upper drip edge of the drip edge along at least the lower edge of the flashing strip member.

20. The method according to claim 16, further comprising:

obtaining a second roofing drip edge device that includes (i) a drip edge, (ii) a flashing strip member, and (iii) a connecting member;

attaching the second roofing drip edge device to the roofing surface, such that the second roofing drip edge device is positioned adjacent to the first roofing drip edge device; and attaching the portion of the flashing strip member that overhangs the first side edge of the drip edge of the first roofing drip edge device to the connecting member of the second roofing drip edge device.

* * * * *